US006280203B1

(12) United States Patent
Smirra

(10) Patent No.: US 6,280,203 B1
(45) Date of Patent: Aug. 28, 2001

(54) ELECTRICAL CONTACT-MAKING CONNECTION AND CONTROLLER FOR A MOTOR VEHICLE HAVING AN ELECTRICAL CONTACT-MAKING CONNECTION

(75) Inventor: Karl Smirra, Wasserburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/479,448

(22) Filed: Jan. 11, 2000

(30) Foreign Application Priority Data

Jan. 11, 1999 (DE) ..... 199 00 639

(51) Int. Cl.[7] ..... H01R 12/00
(52) U.S. Cl. ..... 439/77; 439/863
(58) Field of Search ..... 439/77, 79, 84, 439/80, 111, 162, 278, 271, 283, 329, 381, 577, 879, 863, 393; 264/255

(56) References Cited

U.S. PATENT DOCUMENTS 3,103,547 * 9/1963 Ansley ..... 174/68.5
3,249,908 * 5/1966 Fuller ..... 339/98
4,881,906 * 11/1989 Mackanic et al. ..... 439/83
5,030,134 * 7/1991 Plosser ..... 439/434
5,211,574 * 5/1993 Van Wyk ..... 439/378

FOREIGN PATENT DOCUMENTS

1665815 * 3/1971 (DE) .
4020339A1 1/1991 (DE) .
29501821.6 5/1995 (DE) .
19712842C1 * 8/1998 (DE) .
0394327B1 11/1991 (EP) .
0507062A2 * 10/1992 (EP) .

* cited by examiner

*Primary Examiner*—Tulsidas Patel
*Assistant Examiner*—Son V. Nguyen
(74) *Attorney, Agent, or Firm*—Herbert L. Lerner; Laurence A. Greenberg; Werner H. Stemer

(57) ABSTRACT

An electrical contact-making connection has a metallic pin, a base part with a plug-in opening and an electrical conductor routed to the plug-in opening. The plug-in opening includes an oblique wall surface area oriented at an angle a other than zero with respect to a predefined plug-in direction. On this area, the pin is deflected as it is inserted into the plug-in opening in such a way that it comes to rest on at least one further inner wall surface area of the plug-in opening, while exerting a lateral pressure. The conductor is clamped in the plug-in opening by the deformed pin.

12 Claims, 3 Drawing Sheets

ELECTRICAL CONTACT-MAKING CONNECTION AND CONTROLLER FOR A MOTOR VEHICLE HAVING AN ELECTRICAL CONTACT-MAKING CONNECTION

BACKGROUND OF THE INVENTION

FIELD OF THE INVENTION

The invention relates to an electrical contact-making connection and a controller incorporating the electrical contact-making connection. The contact-making connection is formed of a pin which is inserted into a base part formed with a plug-in opening configured for receiving the pin.

For the purpose of making electrical contact between a metal pin and an electrical conductor, it is already known to use a crimp connection, in which the conductor and the pin are together inserted into a compression bush and are then clamped to each other there. In making the clamped contact, it is disadvantageous that only low fit and assembly tolerances can be accepted, that is to say that high dimensional stability in the production of the connecting elements (pin, conductor, compression bush) is necessary, and that precise prepositioning of the same must take place before they are put together. As a result, the production of the contact-making connection is made more difficult, and costs for making the contact are increased.

In the case of a vehicle controller installed in an engine or a transmission, because of the extreme ambient conditions prevailing there (temperatures between −40° and 140° C., vibration accelerations up to 33 g) and the poor accessibility in the event of a failure, high requirements are placed on the reliability of the contact. In the case of the known crimp connection there is the risk that loosening or, in some cases, even detachment of the electrical clamp contact can occur as a result of fatigue of the compression bush material.

In German Utility Model DE 295 01 821 U1, a description is given of a connecting device for connecting lines to multiple plug sockets. A base part of the connecting device has oblique plug-in openings which open into cable ducts which run horizontally and in which electrical conductors to be firmly clamped are laid. Pins project from a plug part of the connecting device and, when the pins are inserted into the plug-in openings in the base part, they are deflected by the latter and, in the process, clamp the lines routed in the base part.

Published, Non-Prosecuted German Patent Application DE 40 20 339 A1 describes a connecting device in which a fine wire can be fixed by a pin in a tapering sleeve. The pin is equipped with notched teeth, in order to assume a blocking frictional seat in the sleeve.

A clamping element in the form of a leaf spring twisted about its longitudinal axis is described in Published, Non-Prosecuted German Patent Application DE 16 65 815 A. By rotating the spring counter to its prestress, conductor ends located in a sleeve are clamped against one another, achieving high contact forces.

In German Patent DE 197 12 842 C1, a description is given of a controller for a motor vehicle. A housing cover of the controller encloses electrical conductors, whose conductor ends project from the housing cover and project into openings in the base plate. Conductor tracks of a flexible printed circuit board are routed to the openings and are crimped there with the projecting conductor ends.

European Patent EP 0 394 327 B1 describes a central electrical unit for a motor vehicle. This contains, inter alia, a distributor plate with lead-through slots which have holding openings in which first electrical contacts in the form of wire clips are compressed with second electrical contacts in the form of pins and are connected electrically in the process.

In Published, European Patent Application EP 0 507 062 A2, a description is given of a plug strip, which is positively shielded against electromagnetic interference, for electronic controllers in motor vehicles.

SUMMARY OF THE INVENTION

It is accordingly an object of the invention to provide an electrical contact-making connection and a controller for a motor vehicle having an electrical contact-making connection that overcomes the above-mentioned disadvantages of the prior art devices of this general type.

With the foregoing and other objects in view there is provided, in accordance with the invention, an electrical contact-making connection, including:

an electrically conductive pin defining a first electrical contact;

a base part having a plug-in opening formed therein for accommodating the electrically conductive pin, the plug-in opening is defined by an inner oblique wall surface area oriented at an angle a other than zero with respect to a predefined plug-in direction of the electrically conductive pin and by at least one further inner wall surface area disposed to be offset axially from the inner oblique wall surface area, the plug-in opening deflects the electrically conductive pin as the electrically conductive pin is inserted into the plug-in opening and, during insertion the electrically conductive pin is deformed plastically, the electrically conductive pin resting on and exerting a lateral pressure on the at least one further inner wall surface area; and an electrical conductor routed to the plug-in opening and defining a second electrical contact, after the electrically conductive pin has been inserted in the base part the electrical conductor is clamped between the electrically conductive pin and the inner oblique wall surface area and/or the electrically conductive pin and the at least one further inner wall surface area of the plug-in opening.

The invention is based on the object of providing an electrically secure contact-making connection and a motor vehicle controller whose electrical contact-making connections to electrical subassemblies (actuators, sensors) disposed outside the controller are able to withstand high mechanical and thermal stresses.

On the oblique wall surface area provided according to the invention, deliberate plastic deformation of the pin is brought about within the plug-in opening. The plastic deformation is achieved during and as a result of pressing in the pin. The consequence of this is that the pin, in the course of being pressed in further, strikes (at least) a further inner wall surface area of the plug-in opening. The clamping of the electrical conductor to the pin, which implements the making of the electrical contact, takes place on (at least) one of these inner wall surface areas.

One advantage of the invention resides in the fact that no great dimensional stability requirements relating to the lateral pin and plug-in opening dimensions (pin diameter, opening diameter) have to be met.

Nor is any particularly positionally accurate mutual alignment of the connecting parts (pin, plug-in opening) necessary before they are plugged together. It is merely necessary to ensure that the pin encounters the oblique wall surface area which reshapes it as it is inserted into the plug-in opening.

Because of the low requirements on fit and assembly tolerances, the production of the contact-making connection according to the invention is simple and may be automated in a cost-effective manner.

From the point of view of suitability for automation, it is also advantageous that the plug-in forces to be applied can be predefined in a very defined way, since they depend decisively on the material properties (plastic deformability, flexural elasticity) of the pin and not—as in the case of common plug-in connections—on the fitting accuracy of the pin and of the plug-in opening.

Furthermore, the dimensioning of the electrical conductor in relation to its thickness is not critical either. Even for varying conductor thicknesses, it is always possible to ensure, by adequately large dimensioning of the plug-in opening and suitable prepositioning of the pin relative to the plug-in opening, that the conductor cannot shear off at an opening edge of the plug-in opening during the insertion operation.

The electrical conductor is preferably a moveable tab of a flexible printed circuit board with a conductor track running on it. Before the pin is inserted, the tab can overlay the plug-in opening, so that it is drawn into the plug-in opening by the pin during the insertion operation.

The desired degree of deformation of the pin can be influenced and deliberately predefined by a suitable selection of the material properties (flexural elasticity, plastic deformability) of the pin and of the angle a of the oblique wall surface area. As a result, characteristic properties of the contact-making connection, such as the number of contact areas of the pin on the inner wall surface of the plug-in opening (at least two according to the invention), for example, or the spring behavior of the pin between the contact areas can be predefined as desired.

A specific variant of the contact-making connection according to the invention is characterized by the fact that the plug-in opening is formed as a passage opening running through the base part, that after the contact-making connection has been produced, a plastically deformed end section of the pin projects from the passage opening on the outlet side, and that the plastically deformed projecting end section engages behind the rear of the base part. In this way, in addition to achieving the making of an electrical clamp contact, it is also possible to achieve the positive mechanical tensile anchoring of the pin on the base part.

With the foregoing and other objects in view there is further provided, in accordance with the invention, a controller for a motor vehicle, including:

a base plate;

a plastic frame connected to the base plate and having a plug-in opening formed therein and defined by an inner oblique wall surface area oriented at an angle a other than zero with respect to a predefined plug-in direction and at least one further inner wall surface area disposed offset axially from the inner oblique wall surface area;

a circumferential seal;

a housing cover coupled to the base plate in an oil-tight manner via the circumferential seal and defining a cavity formed between the housing cover and the base plate;

an electronic control unit accommodated in the cavity;

a flexible printed circuit board electrically connected to the electronic control unit and routed out between the base plate and the housing cover, the flexible printed circuit board having a tab functioning as a first electrical contact; and a pin functioning as a second electrical contact and in an area of the housing cover disposed outside of the circumferential seal, the pin projecting from the housing cover into the plug-in opening making electrical contact there with the tab of the flexible printed circuit board, the pin being deflected as it is inserted into the plug-in opening and being deformed plastically such that it comes to rest on the at least one further inner wall surface area and exerts a lateral pressure on the at least one further inner wall surface area, the pin clamping the tab between at least one of the pin and the inner oblique wall surface area and the pin and the at least one further inner wall surface area of the plug-in opening.

Other features which are considered as characteristic for the invention are set forth in the appended claims.

Although the invention is illustrated and described herein as embodied in an electrical contact-making connection and a controller for a motor vehicle having an electrical contact-making connection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
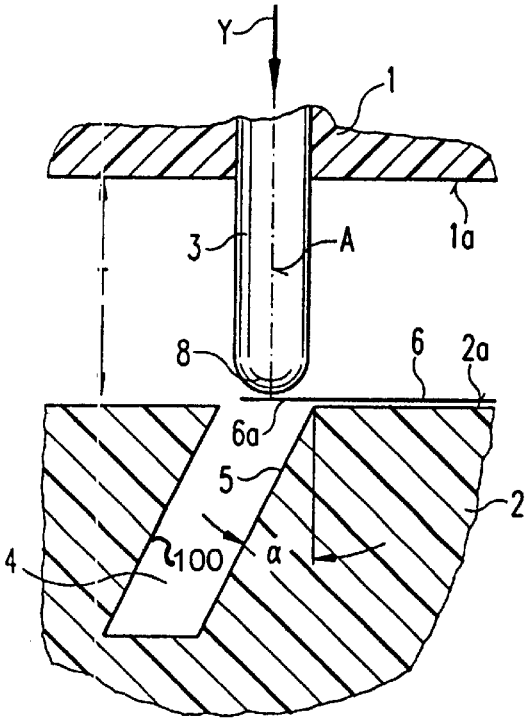
FIG. 1 is a diagrammatic, fragmented, exploded, sectional view of a contact-making connection according to the invention.

In all the figures of the drawing, sub-features and integral parts that correspond to one another bear the same reference symbol in each case. Referring now to the figures of the drawing in detail and first, particularly, to FIG. 1 thereof, there is shown a plug-in part 1 and a base part 2, which are to be connected mechanically to each other in order to form an electrical contact between a metallic pin 3 and an electrical conductor 6, 6*a*. The parts 1, 2 can be produced, for example, from a hard plastic.

The pin 3 is firmly anchored in the plug-in part 1 and projects from the latter in the area of a contact surface 1*a*. A free length of the pin 3 is designated a plug-in depth T. A pin axis A is oriented perpendicular to the contact surface la in the example shown. The pin 3 consists of a material that is plastically deformable and can be bent elastically, consisting preferably of a metal or a metal alloy.

Figure 5A:
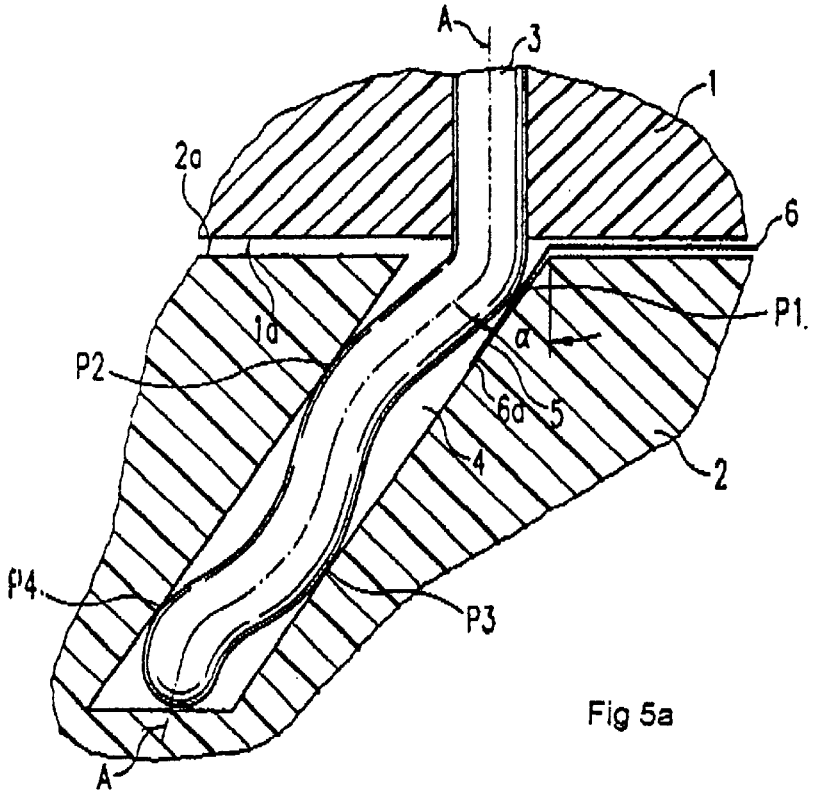
FIG. 5*a* is a fragmented, sectional view of a variant of the contact-making connection shown in FIG. 3 with four contact areas of a pin on an inner wall surface of a plug-in opening.
Figure 5C:
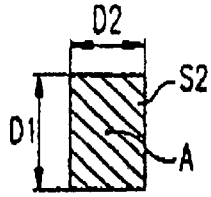
FIGS. 5*b* and 5*c* are sectional views showing a cross-section of the pin.
Figure 5B:
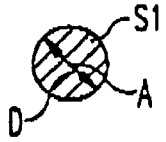

The pin 3 may have, for example, a cross section S1 like a circular disk of diameter D or else a rectangular cross section S2 with side lengths D1 and D2 (see FIGS. 5*b* and 5*c*).

The base part 2 may be constructed in the form of a plate, which is provided with an oblique bore 4. The oblique bore 4 has an oblique wall surface area 5 (here extending over the entire length of the oblique bore). The cross-sectional shape of the oblique bore 4 may correspond to the cross-sectional shape S1, S2 of the pin 3, but is dimensioned to be significantly larger than D, D1, D2.

On its upper side, the base part 2 has a mating contact surface 2*a*, on which the conductor 6 rests, the latter being implemented here in the form of a flexible printed circuit board 6. The flexible printed circuit board 6, of which only a subsection can be seen in FIG. 2, has a printed circuit board tab 6*a* which, before the plug-in part 1 is joined to the base part 2, is disposed above the plug-in opening 4 and at least partly overlaps the latter. A conductor track 7, consisting of copper, for example, extends in the printed circuit board tab 6*a*.

Figure 2:
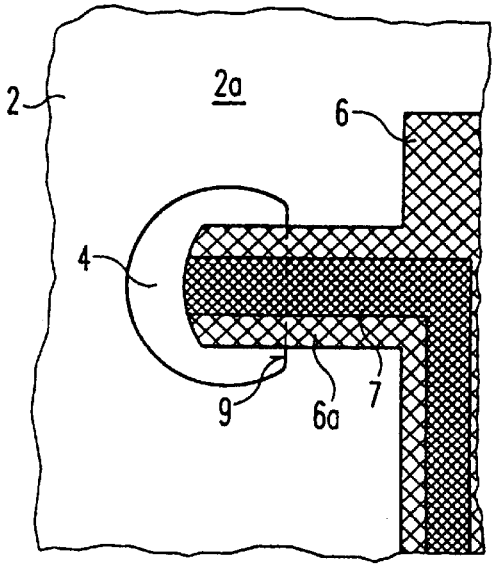
FIG. 2 is a fragmented, plan view of a base part shown in FIG. 1 with a flexible printed circuit board disposed above it.

The printed circuit board tab 6*a* can be constructed either (as illustrated in FIG. 2) as an extension of the flexible printed circuit board 6 projecting beyond its edge, or else as a tongue-like stamped-free section in the printed circuit board 6.

The following text gives an explanation, referring to FIGS. 1 to 4, as to how an electrical contact is made between the pin 3 and the conductor track 7 by joining the two parts 1, 2.

First, the plug-in part 1 is prepositioned in relation to the base part 2, as illustrated in FIG. 1. The necessary positional accuracy of the prepositioning is less and less critical the greater the opening of the oblique bore 4 is dimensioned (in relation to the diameter or the side lengths of pin 3). Referring to FIG. 1, one can see a predefined plug-in direction indicated by an arrow Y. Preferably, the opening of the oblique bore 4 has lateral dimensions, as referenced from the predefined plug-in direction, that are more than 25% larger than the lateral dimensions of the pin 3.

The plug-in part 1 is then lowered onto the base part 2 in the predefined plug-in direction indicated by the arrow Y. The predefined plug-in direction Y and the oblique wall surface area 5 are oriented at an angle $\alpha$ to each other, the direction of the pin axis A here corresponding to the plug-in direction Y, that is to say the pin axis A and the oblique wall surface area 5 are also oriented at the angle $\alpha$ to each other. As it is lowered, a free end 8 of the pin 3 encounters the conductor track tab 6*a* and bends the latter, around an opening edge 9 of the oblique bore 4, into the oblique bore 4.

Figure 3:
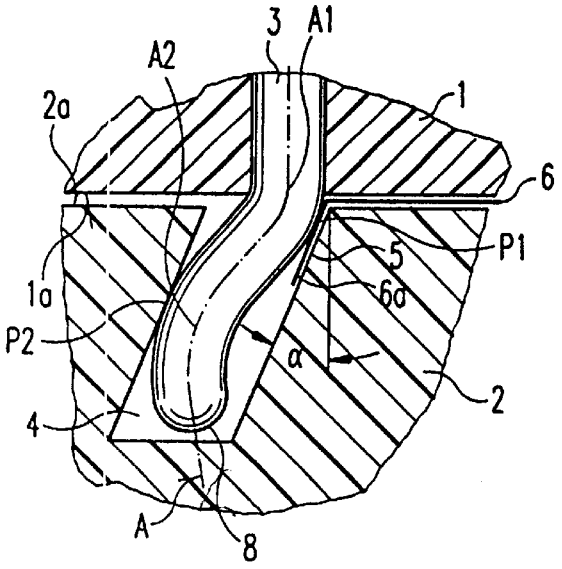
FIG. 3 is a fragmented, sectional view of the contact-making connection shown in FIG. 1 after being joined together.

As it is lowered further, the free end 8 of the pin 3 with the conductor track tab 6*a* positioned in front encounters the oblique wall surface area 5 at a location P1 and is deflected on the latter (FIG. 3). The deflection effects both a (reversible) flexurally elastic deflection and an (irreversible) plastic deformation of the pin 3. The latter leads to a change of shape, which is necessarily required for the present invention, of the pin 3 (see the bend in the pin axis A at A1) in the oblique bore 4.

The angle $\alpha$ can lie, for example, in the range between 10° and 40°.

Because of the deflection experienced at P1, as it is brought down further, the free end 8 of the pin 3 again strikes a (further) inner wall surface area of the oblique bore 4 at the location P2. Here too, a change to the shape of the pin 3 takes place (bending of the pin axis A at A2).

Because of the flexural elasticity of the pin 3, a compressive spring force is built up between the contact areas P1, P2.

The action of making electrical contact between the pin 3 and the conductor track 7 exposed on the tab surface 6*a* is implemented at P1 by clamping the same between the pin 3 and the oblique wall surface area 5, under the action of the compressive spring force.

Pin materials with suitable deformation and elasticity properties are Cu—Sn (for example $CuSn_6$) and Cu—Zn are alloys.

Suitable values for the angle $\alpha$ can lie, for example, between 10° and 25°.

Figure 4:
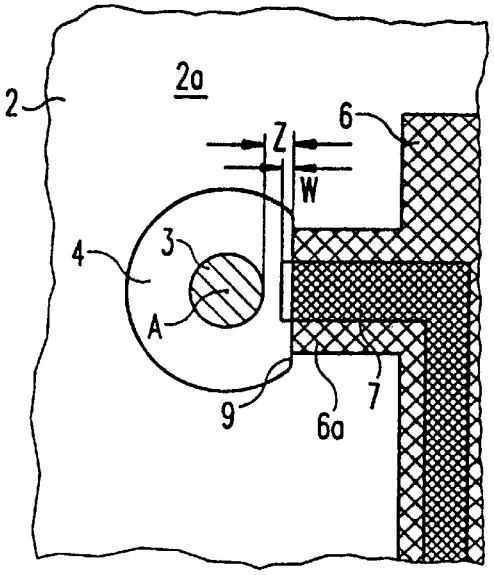
FIG. 4 is a fragmented, plan view of the base part shown in FIG. 3 after being joined together.

FIG. 4 shows the connecting joint illustrated in FIG. 3 in a plan view, the plug-in part 1 not being drawn for illustrative reasons. Between the opening edge 9 and an outer circumference of the pin 3 there is an interspace Z, which is greater than a thickness W of the printed circuit board tab 6*a*. This prevents the printed circuit board tab 6*a* from being sheared off at the opening edge 9 as it is inserted into the oblique bore 4.

FIG. 5 shows a variant of the contact-making connection illustrated in FIG. 3; this initially differs essentially from the latter only in the fact that the plug-in depth T is greater and the angle $\alpha$ is also greater. The result of this is that at locations P3, P4, further contact areas of the pin 3 with the inner wall surface of the oblique bore 4 are produced, and these increase the parting strength and contact-making reliability of the connecting joint. The result is a snake-like course of the pin 3 within the oblique bore 4.

Figure 6:
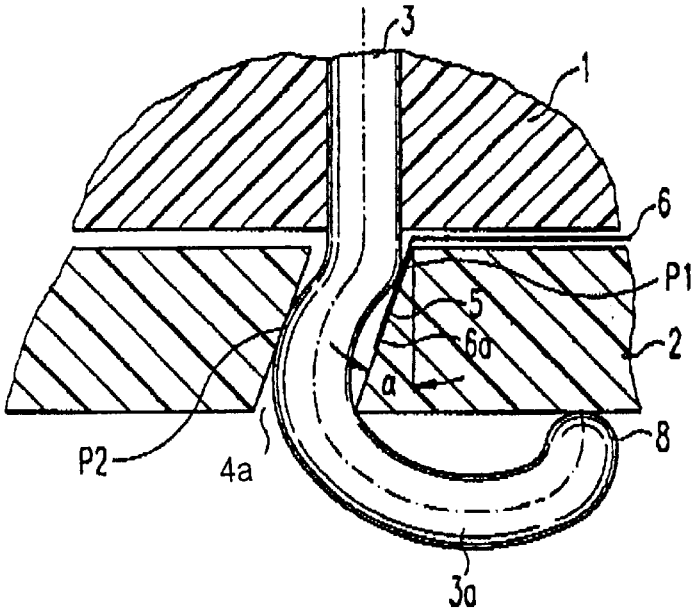
FIG. 6 is a fragmented, sectional view of a further variant of the contact-making connection shown in FIG. 3 with the pin engaging behind the base part.

A further variant of a contact-making connection according to the invention is shown in FIG. 6. Here, the plug-in opening is configured as a passage hole 4*a* which runs through the base part 2. This makes it possible for an end section 3*a* of the pin 3, projecting from the passage hole 4*a*, to roll over behind the base part 2, because of the deflection experienced at P2, and to come to rest with its free end 8 on the rear of the base part 2. In this way, a self-securing contact-making connection is provided.

Figure 7:
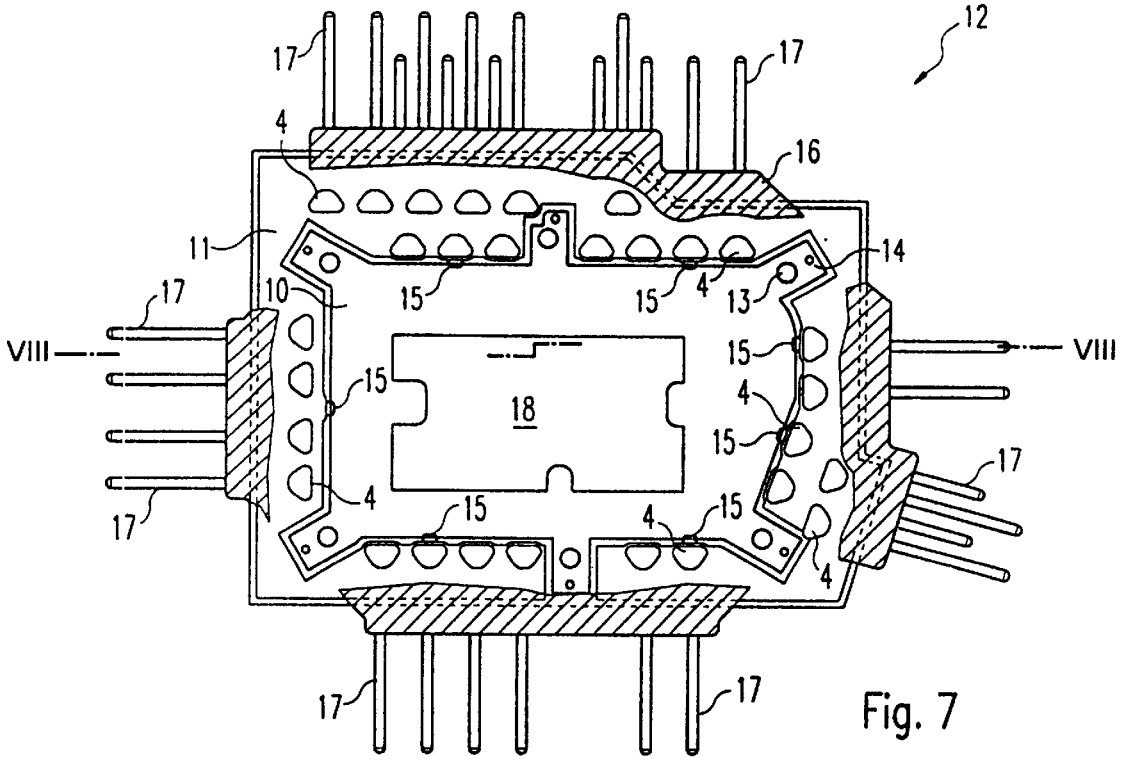
FIG. 7 is a partially broken-away plan view of a transmission controller with a housing cover cut open.

FIG. 7 shows a plan view of a controller 12, which is provided for installation in an automatic transmission of a motor vehicle. A housing is formed by a cover 16 made of plastic, which for illustrative purposes is cut open and only drawn in part, and a base plate 10 disposed underneath. The cover 16 is fastened (in a manner not illustrated), as a supporting element for the housing, to a hydraulic selector plate of the transmission. Encapsulated in the cover 16 are electrical feed lines 17, which lead to non-illustrated actuators and sensors disposed in the transmission.

The base plate 10 preferably consists of aluminum and, in its central area, bears an electronic control unit 18. In its circumferential area, the base plate 10 is provided with outwardly directed extensions 14 with holes 13, by which the base plate 10 can be coupled to the cover 16 via screw connections or the like.

The base plate 10 is surrounded by a plastic frame 11, which adjoins the base plate 10 in a flush manner and continues the latter outward with a flat surface. The connection between the base plate 10 and the plastic frame 11 can be implemented via latching hooks 15, which are fitted to the inside of the plastic frame 11.

The plastic frame 11 forms a base part. According to the invention, it has a large number of the plug-in openings 4 or 4*a*, which can be configured in accordance with the examples shown in FIGS. 1 to 6 and can extend over the frame profile in one or more rows.

Figure 8:
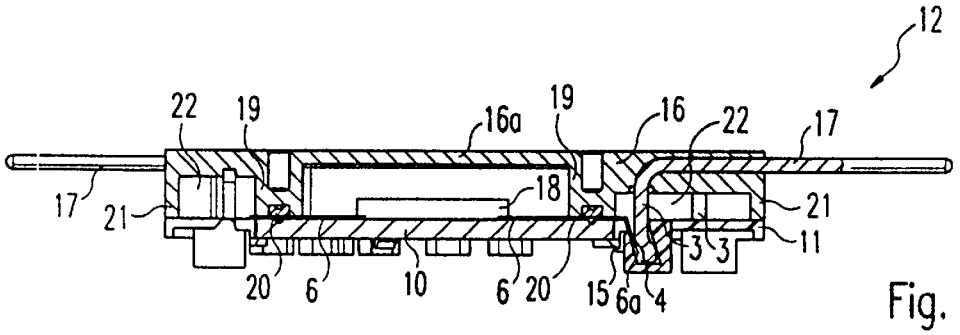
FIG. 8 is a sectional view of the controller shown in FIG. 7 along the line VIII—VIII.

FIG. 8 shows a cross-sectional illustration of the controller 12 shown in FIG. 7, along the line VIII—VIII. The flexible printed circuit board 6 surrounds the electronic circuit 18 on all sides, its conductor tracks making electrical contact with the electronic circuit 18.

A central section 16*a* of cap-like configuration belonging to the housing cover 16 has a circumferential side wall 19. Formed in a bottom area of the side wall 19 is a circumferential groove, into which an annular seal 20 is inserted. The flexible printed circuit board 6 is led out of the housing 10, 16 of the transmission controller 12 between the annular seal 20 and the base plate 10.

Radially outside the circumferential side wall 19, the cover 16 is provided with a skirt-like circumferential edge 21, which forms a chip guard for a chamber-like annular space 22 located between the circumferential side wall 19 and the circumferential edge 21.

The feed lines 17 project from the cover 16 (corresponding to the plug-in part) into the chamber-like annular space 22 in the form of the pins 3. In the plug-in openings 4, 4*a*, they are clamped according to FIGS. 1 to 6 to the printed circuit board tabs 6*a* of the flexible printed circuit board 6, and there make contact with the conductor tracks 7 on the latter. As a result of making electrical contact, the electrical connection between the electronic circuit 18 and the actuators/sensors external to the housing is implemented.

The inner wall of the plug-in opening 4, 4*a* can be lined with a bush 100 made of a hard metal, in order to have adequate hardness for the deflection of the pin 3 during the construction of the connection or else to ensure long-term stability of the contact-making connection.

Because of the high permissible part and assembly tolerances and the simple joining operation, with the electrical contact being made automatically, the controller illustrated can be installed cost-effectively and, because of the spring behavior of the contact-making connections used, has good resistance to vibration and temperature changes.

I claim:

1. An electrical contact-making connection, comprising:

an electrically conductive pin defining a first electrical contact;

a base part having a plug-in opening formed therein for accommodating said electrically conductive pin, said plug-in opening defined by an inner oblique wall surface area oriented at an angle $\alpha$ other than zero with respect to a predefined plug-in direction of said electrically conductive pin and at least one further inner wall surface area disposed to be offset axially from said inner oblique wall surface area, said plug-in opening deflecting said electrically conductive pin as said electrically conductive pin is inserted into said plug-in opening and, during insertion said electrically conductive pin being deformed plastically, said electrically conductive pin resting on and exerting a lateral pressure on said at least one further inner wall surface area and on said inner oblique wall surface area; and an electrical conductor routed to said plug-in opening and defining a second electrical contact, after said electrically conductive pin has been inserted in said base part said electrical conductor being clamped between at least one of said electrically conductive pin and said inner oblique wall surface area and said electrically conductive pin and said at least one further inner wall surface area of said plug-in opening;

said electrical conductor being a moveable tab with a conductor track running on it, said movable tab being part of a flexible printed circuit board.

2. The electrical contact-making connection according to claim 1, wherein said electrically conductive pin has lateral dimensions, and said plug-in opening has lateral dimensions as referenced from the predefined plug-in direction that are more than 25% larger than said lateral dimensions of said electrically conductive pin.

3. The electrical contact-making connection according to claim 1, wherein before being inserted into said plug-in opening, said electrically conductive pin is prepositioned in relation to said base part such that a distance located in an opening plane of said plug-in opening between an opening edge of said plug-in opening adjacent to said electrical conductor, and a circumference of said electrically conductive pin is sufficiently large to rule out a risk of shearing off said electrical conductor at said opening edge as said electrically conductive pin is inserted.

4. The electrical contact-making connection according to claim 3, wherein said electrical conductor has given thickness, and the distance is greater than said given thickness of said electrical conductor.

5. The electrical contact-making connection according to claim 1, wherein said plug-in opening is defined by at least three different inner wall surface areas including said inner oblique wall surface area and said at least one further inner wall surface area, said electrically conductive pin comes to rest on said at least three different inner wall surface areas of said plug-in opening and exerts a lateral pressure on said at least three different inner wall surface areas.

6. The electrical contact-making connection according to claim 5, wherein an exertion of the lateral pressure by said electrically conductive pin on said at least three different inner wall surface areas is brought about by a flexural elasticity of said electrically conductive pin.

7. The electrical contact-making connection according to claim 1, wherein:

said plug-in opening is formed as a passage opening running through said base part and has an outlet side;

after said electrically conductive pin has been inserted in said base part, said electrically conductive pin has a plastically deformed end section projecting from said passage opening on said outlet side; and said base part has a rear and said plastically deformed projecting end section engages behind said rear of said base part.

8. The electrical contact-making connection according to claim 7, wherein said plastically deformed projecting end section has a bent-back area bent back onto said base part and makes mechanical contact with said base part.

9. The electrical contact-making connection according to claim 1, including a bush formed of a hard material lining said plug-in opening.

10. An electrical contact-making connection, comprising:

an electrically conductive pin defining a first electrical contact;

a base part having a plug-in opening formed therein for accommodating said electrically conductive pin, said plug-in opening defined by an inner oblique wall surface area oriented at an angle α other than zero with respect to a predefined plug-in direction of said electrically conductive pin and at least one further inner wall surface area disposed to be offset axially from said inner oblique wall surface area, said plug-in opening deflecting said electrically conductive pin as said electrically conductive pin is inserted into said plug-in opening and, during insertion said electrically conductive pin being deformed plastically, said electrically conductive pin resting on and exerting a lateral pressure on said at least one further inner wall surface area; and an electrical conductor routed to said plug-in opening and defining a second electrical contact, after said electrically conductive pin has been inserted in said base part said electrical conductor being clamped between at least one of said electrically conductive pin and said inner oblique wall surface area and said electrically conductive pin and said at least one further inner wall surface area of said plug-in opening; and wherein said plug-in opening is formed as a passage opening running through said base part and having an outlet side;

after said electrically conductive pin has been inserted in said base part, said electrically conductive pin has a plastically deformed end section protecting from said passage opening on said outlet side;

said base part has a rear and said plastically deformed protecting end section engages behind said rear of said base part;

said plastically deformed protecting end section has a bent-back area bent back onto said base part and makes mechanical contact with said base part; and said plastically deformed projecting end section functions as a spring acting on said base part.

11. A controller for a motor vehicle, comprising:

a base plate having a plug-in opening formed therein and defined by an inner oblique wall surface area oriented at an angle α other than zero with respect to a predefined plug-in direction and at least one further inner wall surface area disposed offset axially from said inner oblique wall surface area;

a circumferential seal;

a housing cover coupled to said base plate in an oil-tight manner via said circumferential seal and defining a cavity formed between said housing cover and said base plate;

an electronic control unit accommodated in said cavity;

a flexible printed circuit board electrically connected to said electronic control unit and routed out between said base plate and said housing cover, said flexible printed circuit board having a moveable tab with a conductor track running on it and functioning as a first electrical contact; and a pin functioning as a second electrical contact and in an area of said housing cover being disposed outside of said circumferential seal, said pin projecting from said housing cover into said plug-in opening making electrical contact there with said tab of said flexible printed circuit board, said pin being deflected as it is inserted into said plug-in opening and being deformed plastically such that it comes to rest on said at least one further inner wall surface area and on said inner oblique wall surface area and exerts a lateral pressure on said at least one further inner wall surface area and on said inner oblique wall surface area, said pin clamping said tab between at least one of said pin and said inner oblique wall surface area and said pin and said at least one further inner wall surface area of said plug-in opening.

12. A controller for a motor vehicle, comprising:

a base plate;

a plastic frame connected to said base plate and having a plug-in opening formed therein and defined by an inner oblique wall surface area oriented at an angle α other than zero with respect to a predefined plug-in direction and at least one further inner wall surface area disposed offset axially from said inner oblique wall surface area;

a circumferential seal;

a housing cover coupled to said base plate in an oil-tight manner via said circumferential seal and defining a cavity formed between said housing cover and said base plate;

an electronic control unit accommodated in said cavity;

a flexible printed circuit board electrically connected to said electronic control unit and routed out between said base plate and said housing cover, said flexible printed circuit board having a moveable tab with a conductor track running on it and functioning as a first electrical contact; and a pin functioning as a second electrical contact and in an area of said housing cover disposed outside of said circumferential seal, said pin projecting from said housing cover into said plug-in opening making electrical contact there with said tab of said flexible printed circuit board, said pin being deflected as it is inserted into said plug-in opening and being deformed plastically such that it comes to rest on said at least one further inner wall surface area and on said inner oblique wall surface area and exerts a lateral pressure on said at least one further inner wall surface area and on said inner oblique wall surface area, said pin clamping said tab between at least one of said pin and said inner oblique wall surface area and said pin and said at least one further inner wall surface area of said plug-in opening.

* * * * *